US005416949A

United States Patent [19]

Jute

[11] Patent Number: 5,416,949

[45] Date of Patent: May 23, 1995

[54] VACUUM UNIT FOR FORKLIFT

[76] Inventor: Kent F. Jute, 27300 Franklin Rd., Apt. 400, Southfield, Mich. 48034

[21] Appl. No.: 210,419

[22] Filed: Mar. 18, 1994

Related U.S. Application Data

[63] Continuation of Ser. No. 957,011, Oct. 6, 1992, abandoned.

[51] Int. Cl.[6] ..... A47L 5/16

[52] U.S. Cl. ..... 15/339; 15/340.3; 15/83

[58] Field of Search ..... 15/52.1, 49.1, 98, 83, 15/229.3, 325, 339, 340.1, 340.3, 347, 340.4; 414/785

[56] References Cited

U.S. PATENT DOCUMENTS

| | | | |
|---|---|---|---|
| 511,543 | 12/1893 | Palmer | 15/347 |
| 1,669,101 | 5/1928 | Russel . | |
| 2,969,557 | 1/1961 | Peterson | 15/325 |
| 3,203,022 | 8/1965 | Clarke | 15/340.1 |
| 3,230,569 | 1/1966 | Nielsen . | |
| 3,345,671 | 10/1967 | Wilson | 15/340.3 |
| 3,407,432 | 10/1968 | Finn | 15/340.3 |
| 3,416,686 | 12/1968 | Penrod | 414/785 |
| 3,431,581 | 3/1969 | Booth . | |
| 3,790,986 | 7/1974 | Burger | 15/347 |
| 3,808,632 | 5/1974 | Aagesen . | |
| 3,837,038 | 9/1974 | Kimzey | 15/340.3 |
| 3,847,576 | 11/1974 | Oberdank | 15/340.3 |
| 3,902,219 | 9/1975 | Jones | 15/340.1 |
| 3,939,528 | 2/1976 | Mossinsohn . | |
| 3,942,214 | 3/1976 | Maasberg . | |
| 4,044,422 | 8/1977 | Larsen | 15/340.1 |
| 4,158,248 | 6/1979 | Pallier . | |
| 4,206,530 | 6/1980 | Kroll | 15/340.1 |
| 4,580,314 | 4/1986 | Anletitner . | |
| 4,754,521 | 7/1988 | Zoni | 15/340.1 |
| 4,823,423 | 4/1989 | Schmid | 15/83 |
| 5,010,620 | 4/1991 | Young | 15/340.3 |
| 5,054,150 | 10/1991 | Best | 15/340.4 |
| 5,138,742 | 8/1982 | Charky | 15/340.1 |

FOREIGN PATENT DOCUMENTS

| | | | |
|---|---|---|---|
| 3316847 | 11/1984 | Germany | 15/340.4 |

*Primary Examiner*—David A. Scherbel
*Assistant Examiner*—Terrence R. Till
*Attorney, Agent, or Firm*—Louis Weinstein

[57] ABSTRACT

A vacuum cleaning unit is mounted to the rear of a conventional forklift truck and operated through the power system of the forklift to provide continuous vacuum cleaning of the floor surface traversed by the forklift during its normal material handling use. Conventional Vacuum cleaning time and frequency is greatly reduced by the use of the forklift cleaning system.

20 Claims, 2 Drawing Sheets

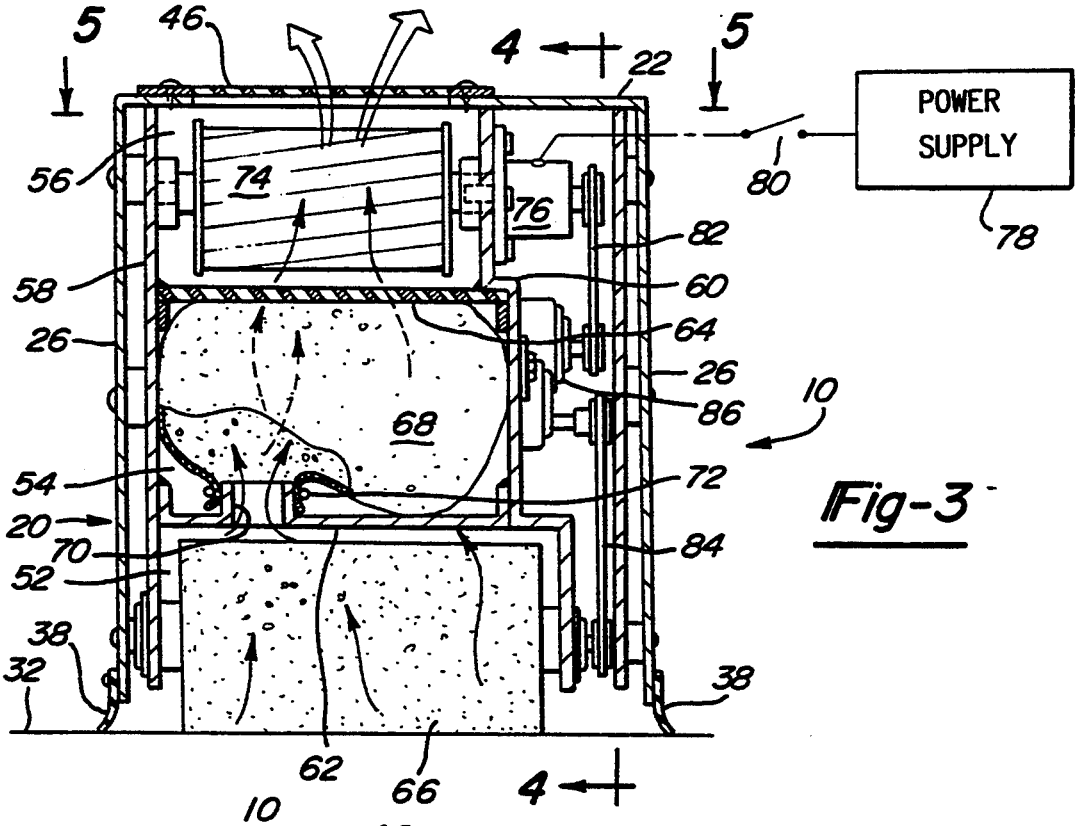
Fig-3
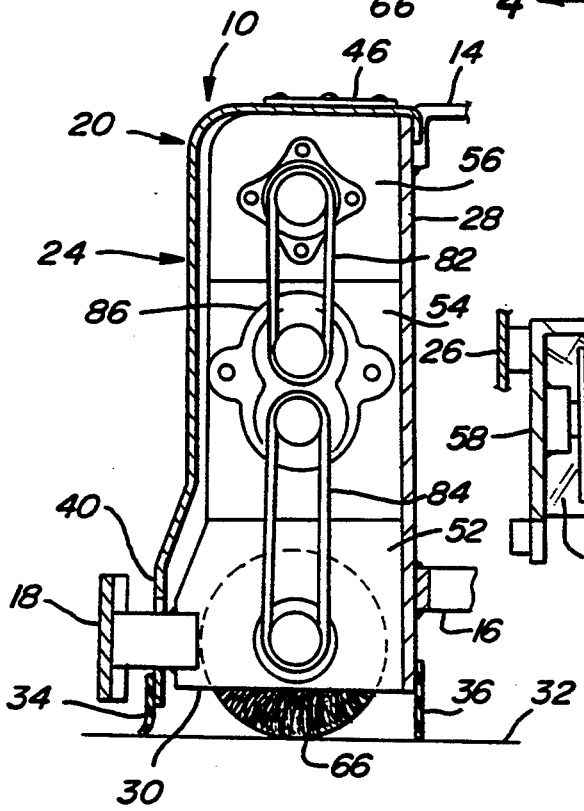
Fig-4
Fig-5
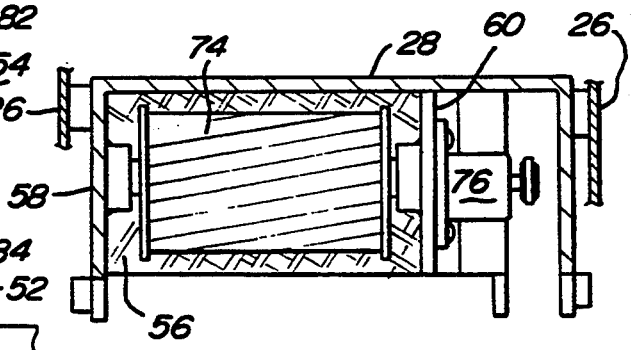

VACUUM UNIT FOR FORKLIFT

This is a continuation of application Ser. No. 07/957,011, filed Oct. 6, 1992, now abandoned.

BACKGROUND OF THE INVENTION

1. Field of the Invention

This invention relates to a vacuum cleaning system, and, more particularly, this invention relates to a unique unit for effecting industrial floor vacuum cleaning.

2. General State of the Art

There is a great variety of industrial vacuum cleaning systems available. For outside, general street cleaning and cleaning of large areas such as parking lots, side walks and the like on a routine basis, dedicated mobile machines are used where vehicles are permanently fitted with a blower, rotating brush, motors and a variety of auxiliary equipment for raising and lowering the brushes and vacuum pickup head and to perform other auxiliary functions.

Where the cleaning function is only performed occasionally, or where a utility vehicle such as a pickup truck is used to perform a variety of tasks, separate units have been attached to the vehicle to perform a cleaning function. For example, trucks are seasonally adapted to perform a snow plowing function, road grading and the like. When a pickup truck is to be used for cleaning, a unit is attached to the front of the truck to perform such a function.

Thus, in the prior art, whether a vehicle is built or dedicated to perform a cleaning function, or a vehicle is temporarily fitted or modified to perform a cleaning function, when the vehicle is used, the primary function is cleaning.

In residential and commercial building floor cleaning, dedicated machines or machines built specifically for cleaning are used.

SUMMARY OF THE INVENTION

The present invention was made with the realization that floor cleaning is a necessary maintenance function in an industrial environment, and that a great deal of time, equipment and expense is involved The present invention permits a substantial reduction in time equipment and attendant expense involved in a strictly floor cleaning function by accomplishing a substantial portion of this cleaning during the normal use of material handling equipment which itself creates or scatters the dirt and trash that must be picked up.

The present invention embraces a cleaning unit which is adapted to be mounted on a forklift to perform a cleaning function while the forklift is used in its conventional material handling mode. Since the forklift traverses the area in which the greatest amount of dirt is created, a sizable portion of the cleaning is accomplished in the material handling mode of the forklift.

The vacuum floor cleaning unit of this invention includes a housing and means for mounting the housing to a rear portion of the forklift. Thus the normal material handling function of the forklift is not hampered, nor is the operator's visibility or maneuverability restricted. Preferably the mounting means firmly seats the housing in a spaced relationship to the rear portion of the forklift to provide adequate ventilation for the forklift motor and fans as is conventionally effected at the rear of the forklift.

Preferably, spaced fastening bars extend from the top of the housing and are attached to the top rear portion of the forklift. Additional fastening bars also extend from adjacent the lower sides of the casing to the rear sides of the forklift.

An intake chamber is located at the bottom of the housing with a rotary brush positioned to contact the floor to be cleaned. A blower is mounted in communication with the intake chamber in a plenum above the intake chamber. Likewise a collection receptacle which is also in communication with the intake chamber is located in a collection chamber above the intake chamber in the housing.

In a preferred form of the invention I locate the collection chamber immediately above the intake chamber and the blower plenum above the collection chamber. In this fashion, the blower creates a vacuum in the intake chamber which forces the dirt and trash loosened by the brush up into the collection receptacle by the action of the blower which is kept free from the dirt being picked up. In other embodiments, the blower plenum can be located directly above the intake chamber to force the dirt and trash through the blower into collection receptacle.

The blower is powered from the power plant of the forklift, and preferably this is accomplished by a connection to the 12 volt power supply for the forklift to run a blower motor. It will be understood that a direct connection, in some cases, could be made between the blower and a forklift motor.

The brush is also preferably driven at a lower speed than the blower which can be accomplished through interconnecting belting and a speed reducer. It will be appreciated, that a separate brush motor could be driven from the forklift power supply.

An on/off switch is preferably located adjacent the forklift operating controls to permit switching off of the cleaning unit in specific areas where dirt pickup is not possible or practical

DRAWING

The advantages of the present invention will be more apparent from the following detailed description when considered in connection with the accompanying drawing wherein:

FIG. 3 is an end elevational view in cross section taken along line 3—3 of FIG. 1;

FIG. 4 is a side elevational view partially in section of the cleaning unit taken along line 4—4 of FIG. 3; and FIG. 5 is a top cross sectional view taken along line 5—5 of FIG. 3.

DETAILED DESCRIPTION OF THE PRESENTLY PREFERRED EMBODIMENTS OF THE INVENTION

Figure 1:
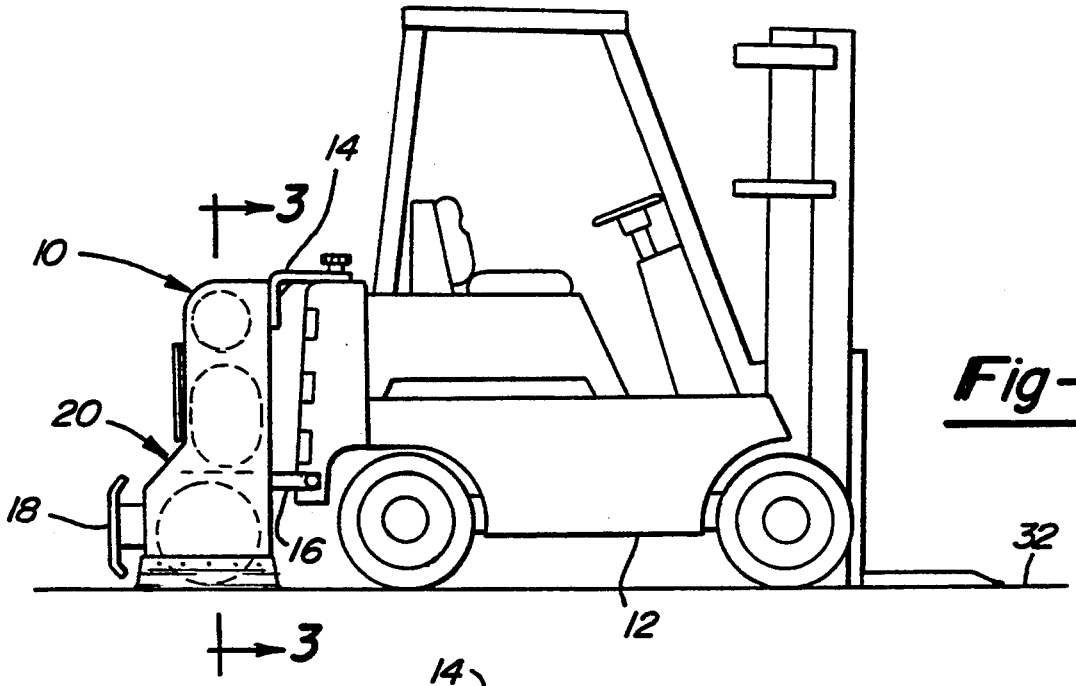
FIG. 1 is a side elevational view showing a conventional forklift with the cleaning unit of the invention mounted to the rear of the forklift.
Figure 2:
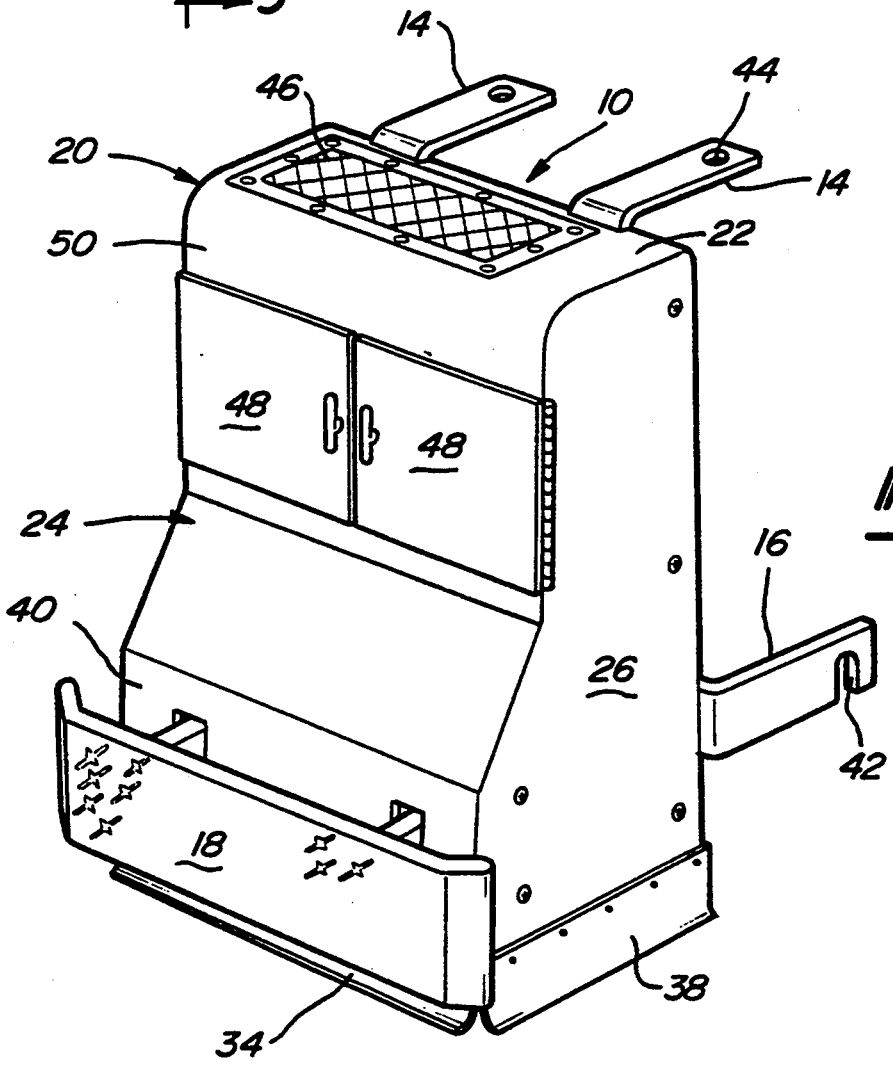
FIG. 2 is a perspective view of the cleaning unit showing the details of the housing and mounting bars along with a bumper mechanism.

Referring to FIG. 1, the floor cleaning unit 10 of the present invention is shown attached to the rear portion of conventional forklift 12 by upper fastening bars 14 and lower fastening bars 16. The cleaning unit 10 has a total enclosure casing or housing 20 with a bumper 18 attached to a lower rear panel of the housing Referring primarily to FIG. 2, the housing top and rearwardly facing walls 22 and 24, are preferably integrally formed. Sidewalls 26 are suitably fastened to the top and rearwardly facing walls 22 and 24, and forwardly facing wall 28 completes the enclosure of the housing 20. The bottom 30 of the housing is open to receive the dirt and debris from floor 32 as the forklift 12 is moved. Flexible rearwardly, forwardly and side facing skirts 34, 36 and 38 depend from the bottom of the casing to seal the vacuum created by the blower to effectively clean the floor surface. Bumper 18 is mounted on the lower panel 40 of wall 24 to guard against accidental impact damage to the cleaning unit 10 The housing is preferably made with sheet metal with the upper fastening bars welded to rear and top walls 28 and 22, and the lower fastening bars welded to wall 28 adjacent sides 26 near bottom 30 of the housing.

The cleaning unit 10 is conveniently mounted on the forklift 12 by sliding bolts protruding from the lower rear side portions of the forklift into slots 42 in lower fastening bars 16, and bolting the upper fastening bars 14 to the top rear portion of the forklift through mounting holes 44. Exhaust grill 46 is screw mounted to the top wall 22 of the housing. Doors 48 in upper panel 50 of rear wall 24 provide access for emptying a collection bag.

As best seen in FIGS. 3 and 4, housing 20 is divided into a lower intake chamber 52, and intermediate collection chamber 54 and an upper plenum 56 by suitably attached vertical baffle walls 58 and 60 with horizontal divider wall 62 between intake chamber 52 and collection chamber 54 and with perforated or louver horizontal wall 64 between collection chamber 54 and blower plenum 56.

Rotary brush 66 is suitable journaled on a horizontal axis in intake chamber 52. A collection receptacle in the form of a porous bag 68 is contained within collection chamber 54 removably connected to duct 70 by flexible sealing ring 72 around a neck portion of the bag. Blower 74 is horizontally journaled in blower plenum 56 rotated by blower motor 76. Motor 76 receives power from the forklift power supply 78 through switch 80

Blower 74 is driven at conventional blower speeds by motor 76, and brush 66 as rotated at a lower speed by interconnected V-belts 82 and 84 through speed reducer 86

In operation, when the forklift 12 is being used for normal material handling, switch 80 will be closed supplying power from the forklift source 78 to blower motor 76. Blower 74 and brush 66, through belts 82 and 84 and reducer 86, will be rotated to pick up dirt from floor 32. The dirt will be sucked through intake chamber 52 and through duct 70 into collection bag 68. The air will be exhausted from the porous collection bag 68 through louvered wall 64 into blower plenum 56 and out through exhaust grill 46.

When the collection bag 68 needs to be emptied doors 48 are opened to provide access for emptying.

It will be readily seen that a substantial floor area will be continuously vacuum cleaned by floor cleaning unit 10 during normal work handling operation of forklift 12 traversing a substantial portion of floor 32. The frequency and time for conventional floor cleaning with a dedicated machine will be greatly reduced.

The embodiments of the invention in which an exclusive property or privilege is claimed are defined as follows:

1. A portable vacuum floor cleaning unit for releasable mounting on a forklift for use during normal operation of the forklift and without interfering with normal forklift operation, said forklift having an operator's seat and an electrical system including drive means and power means for operating said drive means, said unit comprising, in combination:

a housing;

mounting means for releasable mounting of said housing to a rear portion of said forklift, said mounting means including means spacing said unit from said rear portion to permit air to circulate between said unit and said forklift;

a top of said housing being at a height no greater than a height of said operator's seat to provide an operator on said seat with an unobstructed, rearward view from said operator's seat when said unit is mounted on the forklift;

an intake chamber at a bottom of said housing;

a brush rotatably mounted in said intake chamber for contacting a surface to be cleaned;

a blower mounted in said housing in communication with said intake chamber in a plenum directly above said intake chamber;

a collection chamber in said housing arranged directly above said intake chamber;

a removable collection receptacle in said intake chamber for disposing of particulate and the like collected therein; and means for selectively, electrically connecting said unit to said power means.

2. The unit according to claim 1, wherein said mounting means includes spaced fastening bars extending from an upper portion of said housing for mounting to an upper rear portion of said forklift.

3. The unit according to claim 3, wherein said mounting means further includes mounting bars extending from opposite lower sides of said housing for mounting to rear side portions of said forklift.

4. The unit according to claim 1 further comprising an electric motor mounted in said housing and energized by said power means for driving said blower.

5. The unit according to claim 4 further comprising gear reducing means coupled to said electric motor for rotating said brush.

6. The unit according to claim 1 wherein said means for selectively electrically connecting comprises an on/off switch.

7. The unit according to claim 1 further comprising bumper means mounted on a lower portion of said housing and projecting in a rearward direction away from said housing to protect said housing.

8. A unit according to claim 1, further comprising a flexible skirt depending downwardly from a lower end of said housing and engaging a surface to be cleaned and cooperating with the surface to be cleaned to enhance a vacuum created in said intake chamber by said blower.

9. A portable vacuum floor cleaning unit for releasable mounting on a forklift to permit use during normal operation of the forklift and without interfering with normal forklift operation, said forklift having an electrical system including electrical power means, said unit comprising, in combination:

a housing;

mounting means for mounting said housing to a rear portion of said forklift so that a lower end of the housing is spaced above the surface to be cleaned, said mounting means being the sole means for supporting said unit on said forklift;

an intake chamber in said housing provided at a bottom portion thereof;

a brush rotatably mounted in said intake chamber for contacting the surface to be cleaned;

a blower mounted in said housing and being in communication with said intake chamber in a plenum arranged in said housing directly above and in communication with said intake chamber;

a collection chamber directly above and communicating with said intake chamber and said plenum;

a collection receptacle removably provided in said collection chamber;

a means for selectively coupling said blower to said electrical power means; and means coupled between said blower and said brush for rotating said brush.

10. The unit according to claim 9 wherein said collection receptacle comprises a porous bag enabling air to be drawn therethrough and into said plenum while collecting particulate entering into said bag through an opening communicating with said intake chamber.

11. The unit according to claim 10 further comprising a louvered wall providing a passageway for air out of said plenum and into said lower chamber and supporting a portion of said porous bag.

12. The unit according to claim 11 in which a top portion of said housing is provided with an exhaust grill to permit air to be exhausted from the blower plenum.

13. The unit according to claim 9 further comprising a means coupled to said blower for rotating said brush responsive to operation of said blower.

14. The unit according to claim 13 wherein said means for rotating the brush further comprises gear reducing means.

15. The unit according to claim 9 wherein said intake unit, collection chamber and plenum are arranged to provide a substantially direct, upward, vertical path for the movement of air and particulate through said housing, said collection chamber being arranged directly above said intake chamber and directly below said plenum.

16. The unit according to claim 9 wherein said mounting means comprises a first pair of mounting members integral with said housing and extending outwardly from a top forward portion of said housing and toward said forklift;

fastening means for releasably fastening said first mounting means upon a top rear portion of said forklift;

second mounting means comprising a pair of mounting members integral with said housing and extending from opposite sides of said housing towards said forklift; and said side mounting members having mounting slots extending from a lower edge of each side mounting member and upwardly into said mounting member for slidably receiving mounting bolts protruding from opposite side portions of a rear of said forklift to facilitate easy assembly and disassembly thereof.

17. The unit according to claim 16 wherein said first pair of mounting members have openings near free ends thereof and said forklift top rear portion having fastening members extending upwardly therefrom for insertion into an associated one of said openings.

18. The unit of claim 17 further comprising members releasably threadedly secured to said fastening members for securing said first pair of mounting members to said forklift.

19. The unit according to claim 9, further comprising at least one door located along a rear wall of said housing, said door permitting access to said housing to permit said collection receptacle to be emptied.

20. The unit according to claim 9, wherein said mounting means further comprises means for spacing said unit from said forklift to permit the circulation of air between said unit and said forklift.

* * * * *